United States Patent [19]

MacLeod et al.

[11] Patent Number: 4,558,537

[45] Date of Patent: Dec. 17, 1985

[54] CENTERLESS HONING MACHINES HAVING AUTOMATIC SIZE CONTROL

[75] Inventors: Roderick B. MacLeod, Bristol, R.I.; Paul J. Mandeville, Blackstone, Mass.

[73] Assignee: Taft-Peirce Supfina Machine Company, Inc., New York, N.Y.

[21] Appl. No.: 569,769

[22] Filed: Jan. 10, 1984

[51] Int. Cl.[4] ..... B24B 5/04

[52] U.S. Cl. ..... 51/66; 51/165 R; 51/165.92; 51/103 TF

[58] Field of Search ..... 51/59 SS, 66, 67, 103 TF, 51/111, 112, 117, 118, 165 R, 165.92

[56] References Cited

U.S. PATENT DOCUMENTS

| | | | |
|---|---|---|---|
| 2,845,755 | 8/1958 | Price | 51/112 |
| 2,979,869 | 4/1961 | Birleson | 51/103 TF |
| 3,271,909 | 9/1966 | Rutt | 51/165 R |
| 3,654,737 | 4/1972 | Schmidt | 51/66 |
| 4,004,375 | 1/1977 | Wieck | 51/67 |
| 4,274,230 | 6/1981 | Thalheim | 51/165 R |

OTHER PUBLICATIONS

A Copy of a Catalog Entitled "Taft-Peirce Microstoning Machines, Taft-Peirce Catalog 323" Published by The Taft-Peirce Manufacturing Company.

*Primary Examiner*—Harold D. Whitehead

*Attorney, Agent, or Firm*—Burmeister, York, Palmatier, Hamby & Jones

[57] ABSTRACT

Centerless honing machines are described for honing external cylindrical surfaces on a series of workpieces. Each machine comprises a pair of spaced adjacent rotary rollers for supporting and rotating workpieces while also causing them to travel axially along the rollers, at least one honing stone for engaging and honing the workpieces, a fluid pressure operated device for pressing the honing stone against the workpieces, a gaging device for gaging the size of the workpieces and for producing gaging signals, a pressure regulator for supplying fluid pressure to the fluid pressure operated device, and control means operable in response to the gaging signals for adjusting the pressure regulator to increase or decrease the fluid pressure and thereby to increase or decrease the amount of stock removed from the workpieces by the honing stone to achieve closer agreement between the finished size of the workpieces and the desired size.

12 Claims, 9 Drawing Figures

CENTERLESS HONING MACHINES HAVING AUTOMATIC SIZE CONTROL

FIELD OF THE INVENTION

This invention relates to centerless honing machines for honing external cylindrical surfaces on a series of workpieces, so as to give such cylindrical surfaces of smoother finish, while also improving the roundness of the cylindrical surfaces and bringing the size of the cylindrical surfaces into closer agreement with the desired size.

BACKGROUND OF THE INVENTION

Centerless honing machines are in general use for honing external cylindrical surfaces on a series of workpieces, such as pins, shafts and many other types of workpieces. In many cases, the workpieces have previously been machined by a centerless grinding machine or a variety of other machine tools. The honing machine gives the cylindrical surfaces a much smoother finish, while also improving the roundness of the cylindrical surfaces and bringing the size of the cylindrical surfaces into closer agreement with the desired size, the agreement being very close with very small tolerances, in most cases.

A conventional honing machine generally comprises a pair of closely spaced special rollers which are continually rotated by a suitable drive. The rollers support the successive workpieces and cause them to rotate, while also causing the workpieces to travel axially along the length of the rollers. Generally, a continuous stream of workpieces is supplied to the rollers at one end. The workpieces are honed as they travel along the length of the rollers, and the finished workpieces are removed as a continuous stream from the rollers at the opposite end.

The workpieces are honed by pressing honing elements, such as honing stones, against the traveling workpieces as they are rotated by the rollers. Thus, the workpieces are honed by the abrasive action of the stones. Generally, the honing stones are oscillated rapidly in a direction parallel with the axes of the workpieces, so as to produce a better finish.

Generally, the honing stones are mounted on supporting members which are guided for movement in a direction perpendicular to the axes of the workpieces.

The honing stones are pressed against the workpieces by pressing devices acting upon the supporting members. Such pressing devices may take the form of springs, fluid pressure operated cylinders, or other fluid pressure operated devices. Either air pressure or hydraulic pressure may be employed, although air pressure is generally preferred.

The honing stones remove a small amount of stock from the workpieces by abrasive action, so that the size of the cylindrical surfaces, after honing, is slightly smaller than before honing. It is generally desired to hold the finished size of the honed workpieces to very close tolerences. Thus, it is important to have the honing machine remove enough stock from the workpieces, but not too much.

The amount of stock removed from the workpieces is a function of the pressure which is exerted between the honing stones and the workpieces. Increasing the pressure increases the amount of stock removed, and vice versa.

To provide for close control over the finished size of the honed workpieces, conventional honing machines may have manually operable means for regulating the force applied to the stone supporting members. When the force is developed by fluid pressure cylinders or other fluid pressure actuated devices, a manually adjustable pressure regulating may be employed to vary the fluid pressure supplied to the fluid pressure cylinder. This method of manual control requires that the operating person who operates the machine be highly skilled. Moreover, the operator must give close attention to the adjustment of the honing machine on a virtually continuous or highly frequent basis, to maintain the desired close tolerences. Thus, the operation of a conventional centerless honing machine involves a high labor cost.

SUMMARY OF THE INVENTION

One principal object of the present invention is to provide a new and improved centerless honing machine in which the pressure between the honing element or elements and the workpieces is automatically regulated so as to maintain extremely close control over the size of the finished workpieces.

To achieve this and other objects, the present invention preferably comprises a centerless honing machine for honing external cylindrical surfaces on a series of workpieces, such honing machine comprising a pair spaced adjacent rotary roller means for supporting and rotating the workpieces while also causing the workpieces to travel axially along the roller means, at least one honing element for engaging and honing the successive workpieces as they travel axially along the roller means, pressing means operable by fluid pressure for pressing the honing element against the workpieces, gaging means for gaging the size of the cylindrical surfaces on the workpieces and for producing signals indicating the relationship between the size of the workpieces and the desired size, pressure regulating means for supplying fluid pressure to the pressing means, and control means operable in response to such signals for adjusting the pressure regulating means to increase or decrease the fluid pressure and thereby to increase or decrease the amount of stock removed from the workpieces by such honing element, to achieve closer agreement between the finished size of the workpieces and the desired size.

Generally, there are a plurality of honing elements which are generally in the form of honing stones or other abrasive elements.

In some cases, the gaging means may be located to gage the size of the workpieces as they travel toward the honing element and before they are engaged by the honing element.

In other cases, the gaging means may be located to cage the finished size of the workpieces as they travel away from the honing element after being engaged and honed by the honing element.

In still other cases, the gaging means may include first and second gaging devices for gaging the size of the workpieces, both before and after they are engaged and honed by the honing element. Both of the gaging devices may produce gaging signals which are supplied to the control means. The first gaging device may be located to gage the size of the workpieces as they travel toward the honing element and before they are engaged by the honing element. The second gaging device may be disposed to gage the finished size of the workpieces as they travel away from the honing element, after being honed. The control means may be responsive to the gaging signals from both the first and second gaging devices. In some cases, there may be a plurality of honing elements for successively engaging and honing the traveling workpieces, a plurality of pressing means for pressing the respective honing elements against the workpieces, and a plurality of pressure regulating means operable by the control means for varying the fluid pressure supplied to the respective pressure means.

The gaging means may be in the form of a continuously operating gaging device utilizing a variable transformer or some other electrical or electronic device for producing gaging signals. Other known or suitable gaging devices may be employed.

The control means may include a stepping motor for adjusting the pressure regulator, and means for operating the stepping motor in response to the gaging signals. In some cases, there may be a plurality of pressure regulators, a plurality of stepping motors, and a plurality of electronic control circuits for operating the stepping motors.

BRIEF DESCRIPTION OF THE DRAWINGS

Further objects, advantages and features of the present invention will appear from the following description of illustrative embodiments, taken with the accompanying drawings, in which:

As just indicated, FIG. 1 illustrates a centerless honing machine 20 to be described as an illustrative embodiment of the present invention. The honing machine 20 is adapted to hone cylindrical surfaces on a series of workpieces 22 which may be delivered or fed in a continuous flow or stream to a pair of closely spaced transport rollers 24. The stream of the workpieces 22 may be received directly from another machine tool, which may perform a sizing operation, such as a centerless sizing operation, upon the workpieces 22. For example, the previous machine tool may be a centerless grinding machine which grinds the cylindrical surfaces of the workpieces 22 to a desired diameter, within relatively close tolerances. The successive workpieces 22 are fed continuously to the transport rollers 24 along a suitable trough or other guide means 26, indicated diagrammatically in FIG. 1. The trough 26 may extend between the previous machine tool and the transport rollers 24.

Figure 1:
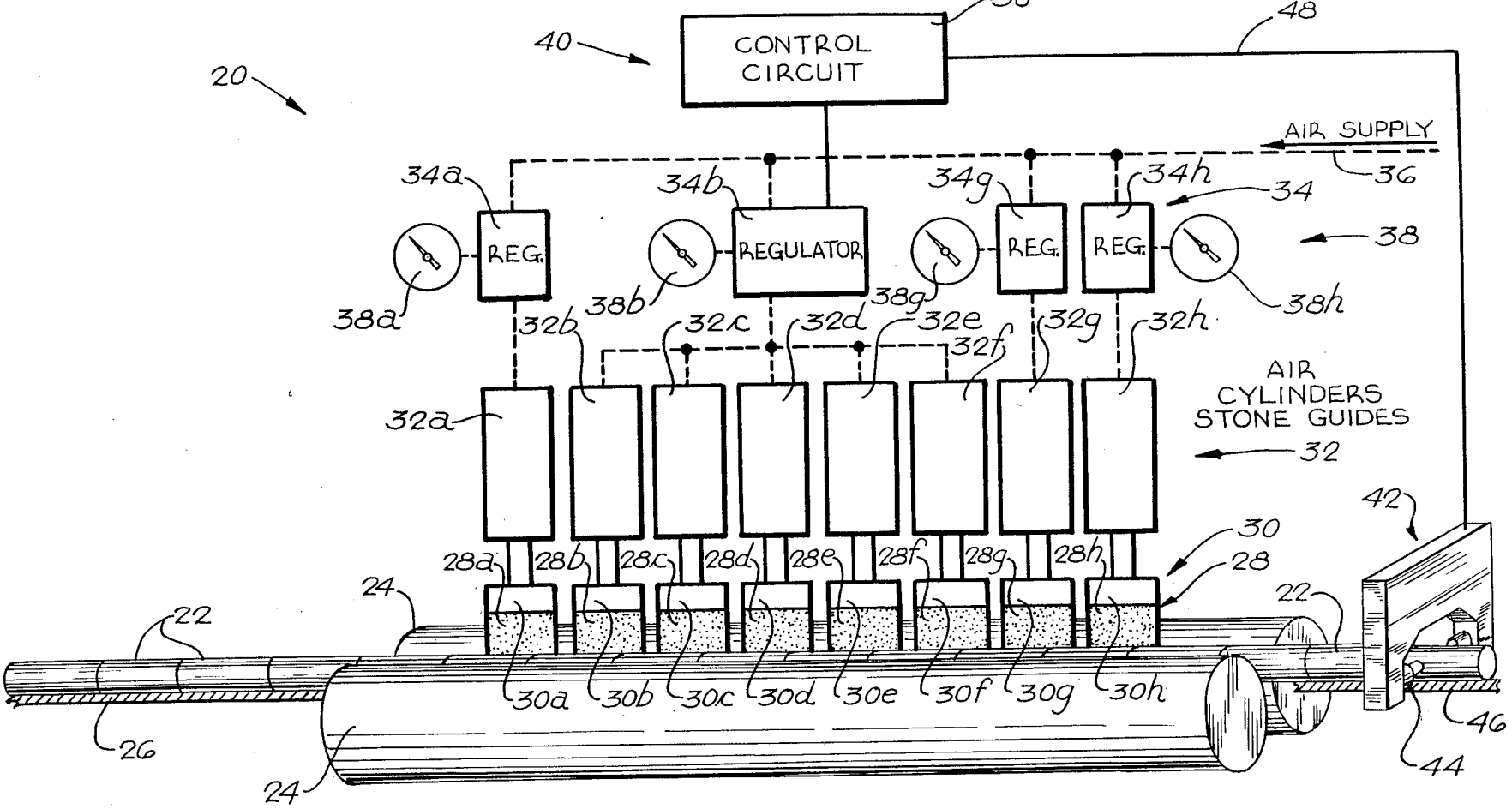
FIG. 1 is a somewhat diagrammatic perspective view of a centerless holding machine to be described as a first illustrative embodiment of the present invention, such machine having a gaging device for gaging the workpieces after they are honed by the machine.

The general purpose of the honing machine is to hone the cylindrical surfaces on the workpieces 22, so as to give the cylindrical surfaces a much smoother finish, while also improving the roundness of the cylindrical surfaces and bringing the size of the cylindrical surfaces even closer to the desired size, within extremely close tolerances.

The transport rollers 24 are continuously rotated by an suitable drive, so as to impart continuous rotation to the workpieces 22. The spacing between the rollers 24 is less than the diameter of the workpieces 22 so that the workpieces are supported on both rollers 24, above the space therebetween, and are frictionally driven by the rotating rollers 24.

The transport rollers 24 are constructed and arranged in a manner which is known to those skilled in the art so that the rollers 24 also cause the workpieces 22 to travel longitudinally along the rollers 24, in an axial direction, with reference to the common cylindrical axis of all of the cylindrical surfaces on the workpieces 22. This axis is sometimes described as the Z-axis of the honing machine 20. Thus, the Z-axis is the axis along which the cylindrical workpieces 22 are transported.

As the workpieces 22 are rotated and transported by the rollers 24, the workpieces are honed by one or more honing elements 28, such as honing stones or other abrasive elements. Any suitable number of honing stones or elements 28 may be employed. The honing machine 20 of FIG. 1 utilizes 8 successive honing stones 28*a*–28*h*. For convenience, the honing stones 28*a*–28*h* will frequently be referred collectively as the honing stones 28.

The honing stones 28 are pressed or pushed against the external cylindrical surfaces of the workpieces 22 as they are rotated and transported by the rollers 24. The honing stones 28 have an abrasive action which hones the external cylindrical surfaces. The abrasive honing action removes a multitude of minute peaks on the cylindrical surfaces, so that they are made much smoother, rounder and closer to the desired size, within very clse tolerances.

The honing stones 28 are mounted on supports 30 which are movable toward and away from the workpieces 22. In FIG. 1, the individual supports for the respective honing stones 28*a*–28*h* are designated 30*a*–30*h*. The direction of movement of the stones 28, toward and away from the workpieces 22, may be designated the Y-axis of the machine.

The stone supports 30 are guided for movement along the Y-axis by guiding and pressing devices 32 which also exert force to produce pressure between the honing stones 28 and the workpieces 22. The guiding and pressing devices 32 preferably take the form of fluid pressure cylinders 32*a*–32*h* for guiding and pressing the respective stones 28*a*–28*h*. Either air pressure or hydraulic pressure may be employed to operate the fluid pressure cylinders 32*a*–32*h*, but it is generally preferable to utilize air pressure. Other known or suitable pressure-exerting devices may be employed.

The amount of pressure developed between the honing stones 28 and the workpieces 22 is a function of the fluid pressure supplied to the fluid pressure cylinders or devices 32. To provide for variation of the pressure between the honing stones 28 and the workpieces 22, the honing machine 20 comprises means for varying such fluid pressure, supplied to the cylinders 32, such means being shown in FIG. 1 as pressure regulators 34, connected between an air supply line 36 and the fluid pressure cylinders 32. It will be understood that the air supply line 36 is connected to an air compressor or some other source of air pressure. In some cases, the individual air cylinders 32 may be provided with individual pressure regulators 34. In other cases, a single pressure regulator 34 may be employed to supply air to a group of the air cylinders 32. Thus, in FIG. 1, the air cylinders 32*a*, 32*g* and 32*h* are provided with individual pressure regulators 34*a*, 34*g* and 34*h*. The other air cylinders 32*b*, 32*c*, 32*d*, 32*e*, and 32*f* are grouped together and are supplied with air pressure in common by a single pressure regulator 34*b*.

The pressure regulators 34 are preferably provided with pressure gages 38 for measuring the fluid pressure at the outputs of the respective pressure regulators. As shown, the respective pressure regulators 34*a*, 34*b*, 34*g* and 34*h* have corresponding pressure gages 38*a*, 38*b*, 38*g* and 38*h*.

In the honing machine 20 of FIG. 1, at least one of the pressure regulators 34 is automatically adjustable by an automatic control system, while other of the regulators may be manually adjustable. As shown, the pressure regulators 34*a*, 34*g* and 34*h* are manually adjustable, while the pressure regulator 34*b* is automatically adjustable as part of an automatic control system which varies the pressure exerted by some of the honing stones 28 against the workpieces 22, so as to vary the amount of stock which is removed from the workpieces. In this way, the finished size of the honed workpieces 22 is controlled within very close tolerances. As shown, the automatically controlled pressure regulator 34*b* controls the fluid pressure supplied to the air cylinders 32*b*–32*f* and thereby regulates the pressure exerted between the workpieces 22 and the honing stones 28*b*–28*f*.

As just indicated, the automatically controllable pressure regulator 34*b* is a component of an automatic control system 40 which also utilizes gaging means 42 comprising a gaging device 44 which is disposed to gage the size or diameter of the successive workpieces 22, as they travel away from the transport rollers 24, after the workpieces have been honed. As the workpieces 22 travel away from the transport rollers 24, the workpieces are supported by a suitable trough or other guide 46 shown diagrammatically in FIG. 1.

The gaging device 44 produces gaging signals which indicate the relationship between the actual gaged size of the workpieces 22 and the desired size. Such gaging signals are supplied along a signal line 48 to a control unit 50, which automatically adjusts the pressure regulator 34*b* to compensate for variations in the size of the workpieces 22, so that the size will be maintained within very close tolerances. If the gaging device 44 determines that the finished size of the honed workpieces 22 is slightly greater than the desired size, the control unit 50 readjusts the pressure regulator 34*b* so as to increase the fluid pressure supplied to the air cylinders 32*b*–32*f*, so that increased pressure is developed between the workpieces 22 and the honing stones 28*b*–28*f*. The greater pressure causes the honing stones to remove a slightly greater amount of stock from the workpieces 22, so that the finished size of the workpieces is brought down closer to the desired size. On the other hand, if the gaging device 44 indicates that the size of the finished workpieces 22 is slightly less than the desired size, the gaging signals causes the control unit 50 to readjust the pressure regulator 34*b* so that the fluid pressure supplied to the air cylinders 32*b*–32*f* is decreased. In this way, the honing stones 28*b*–28*f* apply a slightly reduced pressure to the workpieces 22, so that less stock is removed from the workpieces. In this way, the size of the finished workpieces is brought up to or closer to the desired size. The control unit 50 may include a timing means or clock for readjusting the pressure regulator 34*b* at regularly spaced intervals as needed, to allow for the time required for the honed workpieces 22 to travel between the honing stones 28 and the gaging device 44. In this way, hunting of the control system is prevented or minimized. Additional details of the control system 40 will be described presently.

Figure 2:
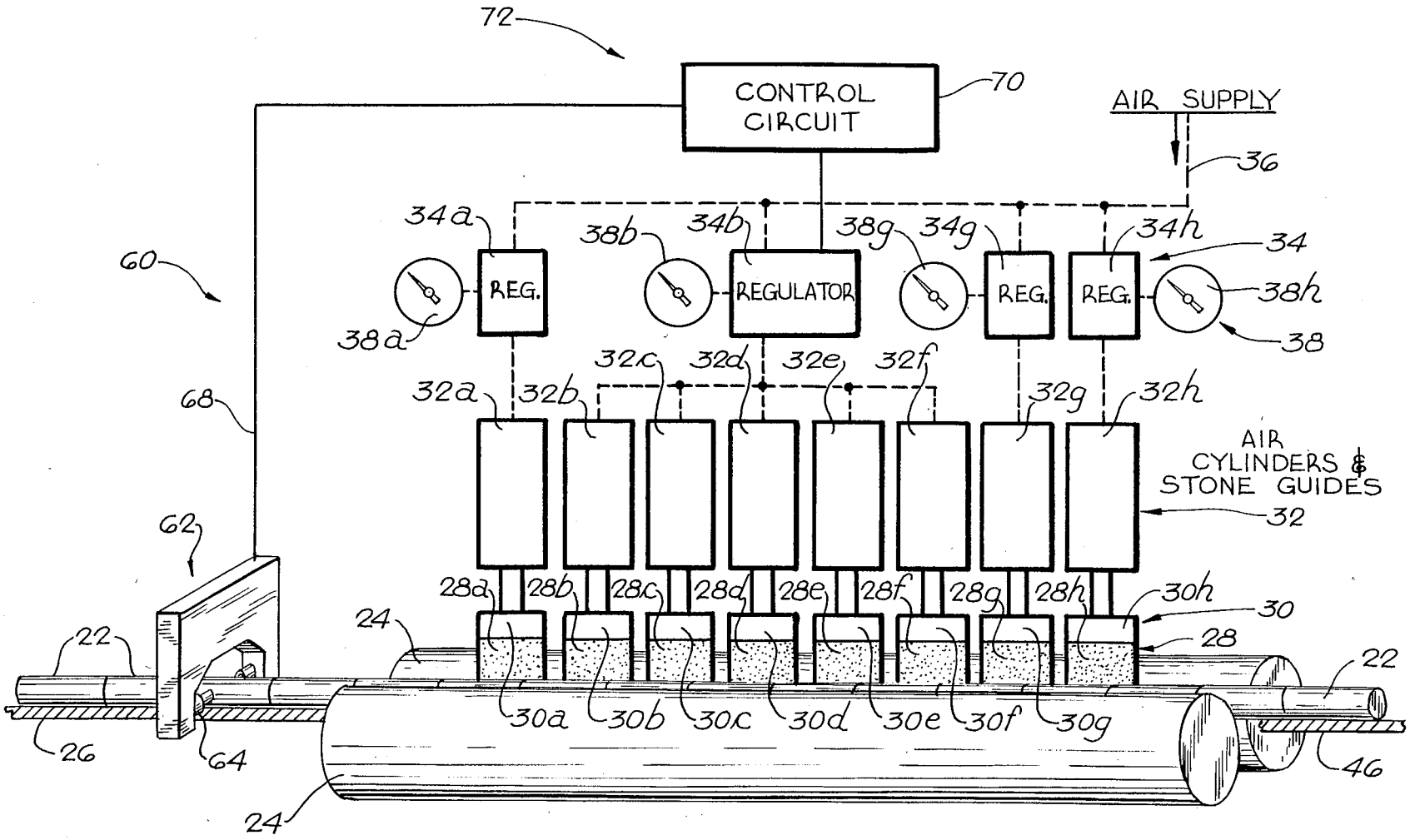
FIG. 2 is a somewhat diagrammatic perspective view of a centerless honing machine to be described as a second illustrative embodiment of the present invention, such machine having a gaging device for gaging the workpieces before they have been honed by the machine.

FIG. 2 illustrates a second embodiment of the present invention is the form of a modified honing machine 60, which is the same in many respects as the honing machine 20 of FIG. 1. The same reference characters have been employed in FIGS. 1 and 2 to indicate those components which are the same in both honing machines 20 and 60. This applies to the workpieces 22, the transport rollers 24, the guide 26, the honing stones 28, the stone supports 30, the combined stone guides and fluid pressure cylinders 32, the pressure regulators 34, the air supply line 36, the pressure gages 38, and the guide 46.

The honing machine 60 of FIG. 2 is modified in that it utilizes gaging means 62 comprising a gaging device 64 which is similar to the gaging device 44, but is relocated so as to gage the workpieces 22 as they travel toward the transport rollers 24, before the workpieces 22 are honed. The gaging device produces gaging signals which indicate the relationship between the actual gaged size of the workpieces 22 and the desired size. Such gaging signals are transmitted along a signal line 68 to a control unit 70, which automatically readjusts the pressure regulator 34*b*. The gaging device 64, the control unit 70 and the automatically adjustable pressure regulator 34*b* are components of an automatic control system 72.

If the gaging device 64 determines that the incoming workpieces 22 are slightly larger than the desired size, the gaging signal causes the control unit 70 to readjust the pressure regulator 34*b* so as to increase the fluid pressure supplied to the air cylinders 32*b*–32*f*, so that the pressure exerted upon the workpieces 22 by the honing stones 28*b*–28*g* is increased. In this way, the greater amount of stock is removed from the workpieces 22 by such honing stones, so that the finished workpieces are brought closer to the desired finished size, within very close tolerances. On the other hand, if the gaging device 64 determines that the incoming size of the workpieces 22 is slightly less than the desired size, the gaging signals cause the control unit 70 to readjust the pressure regulator 34*b* so as to supply a lower fluid pressure to the cylinders 32*b*–32*f*. In this way, the pressure between the workpieces 22 and the honing stones 28*b*–28*f* is decreased, so that less stock is removed from the workpieces 22 by the honing machine 60. In this way, the finished size of the workpieces 22 is held very close to the desired size, within very close tolerances. Additional details of the automatic control system 72 will be described presently.

Figure 3:
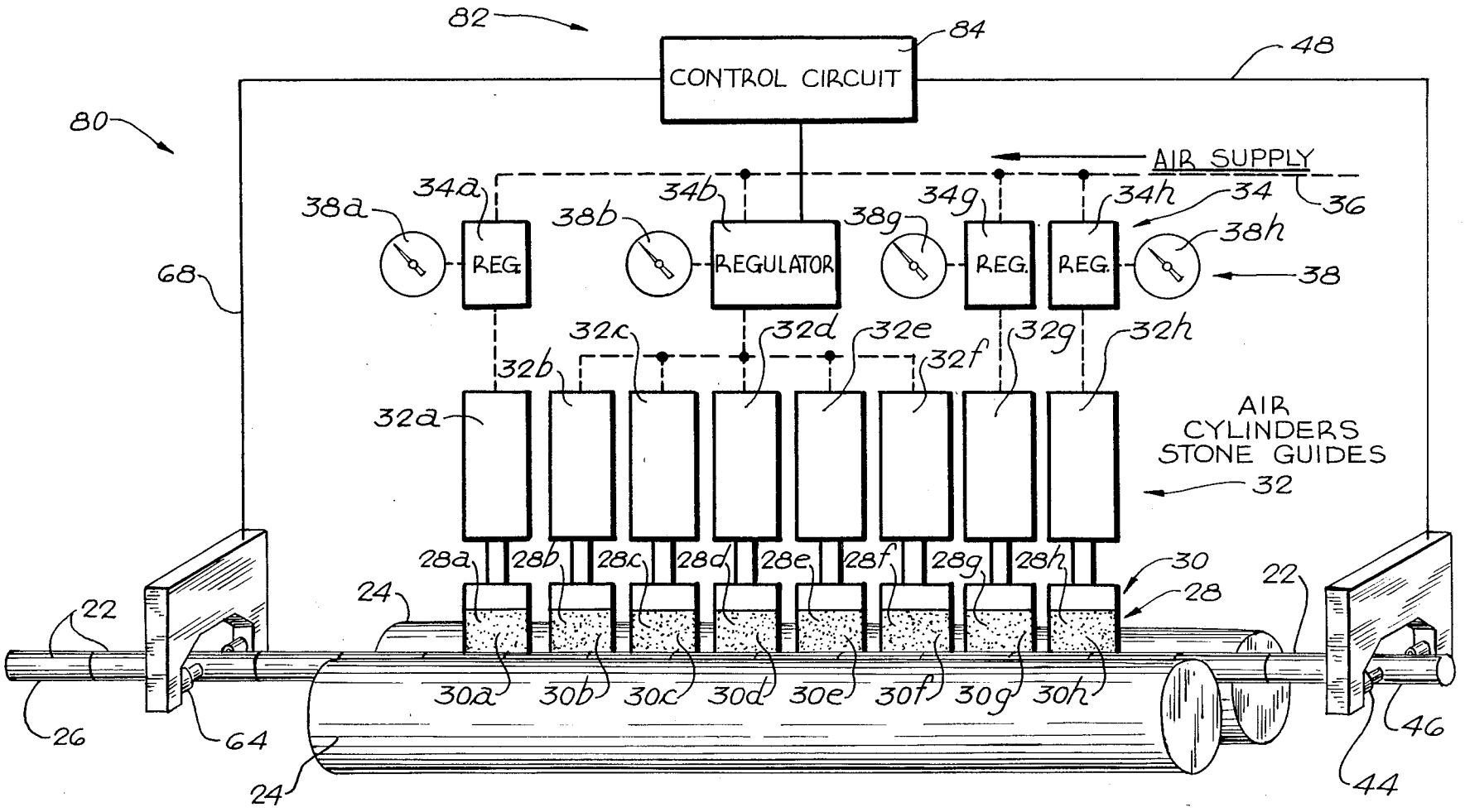
FIG. 3 is a somewhat diagrammatic perspective view of another centerless honing machine to be described as a third illustrative embodiment of the present invention, such machine having first and second gaging devices for gaging the workpieces, both before and after they are honed by the machine.

FIG. 3 illustrates the third embodiment of the present invention in the form of another modified centerless honing machine 80 which combines many of the features of the honing machines 20 and 60 of FIGS. 1 and 2, in that the workpieces 22 are gaged both before and after they are honed by the machine 80. Most of the components of the honing machine 80 are the same as the components of the honing machines 20 and 60. To that extent, the same reference characters are employed in FIG. 3 as employed in FIGS. 1 and 2. Thus, the honing machine 80 utilizes the transport rollers 24, the guide 26, the honing stones 28, the supports 30 for the honing stones 28, the combined stone guides and fluid pressure cylinders 32, the pressure regulators 34, the air supply line 36, the pressure gage 38, the gaging device 44, the guide 46, the gaging signal line 48, the gaging device 64 and the gaging signal line 68.

As before, the gaging device 46 gages the finished workpieces 22, after they have been honed by the machine 80. The gaging device 44 is positioned to gage the finished workpieces 22 as they depart from the transport rollers 24. The gaging device 46 produces gaging signals which indicate the relationship between the actual gage size of the finished workpieces 22 and the desired size.

As previously described, the gaging device 64 is positioned to gage the workpieces 22 as they are fed in a continuous stream to the transport rollers 24, before the workpieces have been honed. The gaging device 64 produces gaging signals which indicate the relationship between the actual gaged size of the workpieces 22 and the desired size.

In the honing machine 80, the pressure regulator 34*b*, the gaging device 44, the signal line 48, the gaging device 64, and the signal line 68 are components of an automatic control system 82 which also comprises a control unit 84 to which the gaging signals are supplied by the signal lines 48 and 68. The control unit 84 is operative in response to both sets of gaging signals to readjust the fluid pressure regulator 34*b* so as to vary the pressure applied to the workpieces 22 by the stones 28*b*–28*f*. If the incoming gaging device 64 indicates slightly oversized workpieces, the control unit 84 makes a preliminary readjustment of the pressure regulator 34*b*, so as to increase the fluid pressure supplied to the cylinders 32*b*–32*f*, whereby the pressure applied to the workpieces 22 by the honing stones 28*b*–28*f* is increased to increase the amount of stock removed from the workpieces. If the gaging device 64 indicates that the workpieces 22 are slightly smaller than the desired size, the control unit 84 makes an opposite preliminary adjustment of the pressure regulator 34*b*, so as to reduce the honing pressure on the workpieces 22, whereby less stock is removed by the honing stones 28.

The control unit 84 makes a more refined adjustment of the pressure regulator 34*b* in response to the gaging signals from the gaging device 44, which gages the finished workpieces. If the gaging device 44 indicates that the finished workpieces are slightly larger than the desired size, the control unit 84 readjusts the pressure regulator 34*b* to a slightly higher setting, so that a slightly greater pressure is applied to the workpieces 22 by the honing stones 28*b*–28*f*. Conversely, if the gaging device 44 indicates that the size of the workpieces is slightly less than the desired size, the control unit 84 makes an opposite adjustment of the pressure regulator 34*b*, so as to reduce the fluid pressure, whereby the pressure applied to the workpieces 22 by the honing stones 28*b*–28*f* is slightly reduced, to reduce the amount of stock removed from the workpieces by the honing stones. In this way, the finished size of the workpieces 22 is held to the desired size within very close tolerances. Additional details of the control system 82 will be described presently.

In each of the three honing machines 20, 60 and 80 of FIGS. 1, 2 and 3, any known or suitable means may be provided for oscillating the honing stones 28 along the Z-axis of the machine, parallel to the axes of the workpieces 22. Persons skilled in the art will be familiar with such oscillating means. Such longitudinal oscillation of the honing stones 28 results in the production of a smoother finish on the cylindrical surfaces of the workpieces 22, and a better honing operation generally.

Figure 4:
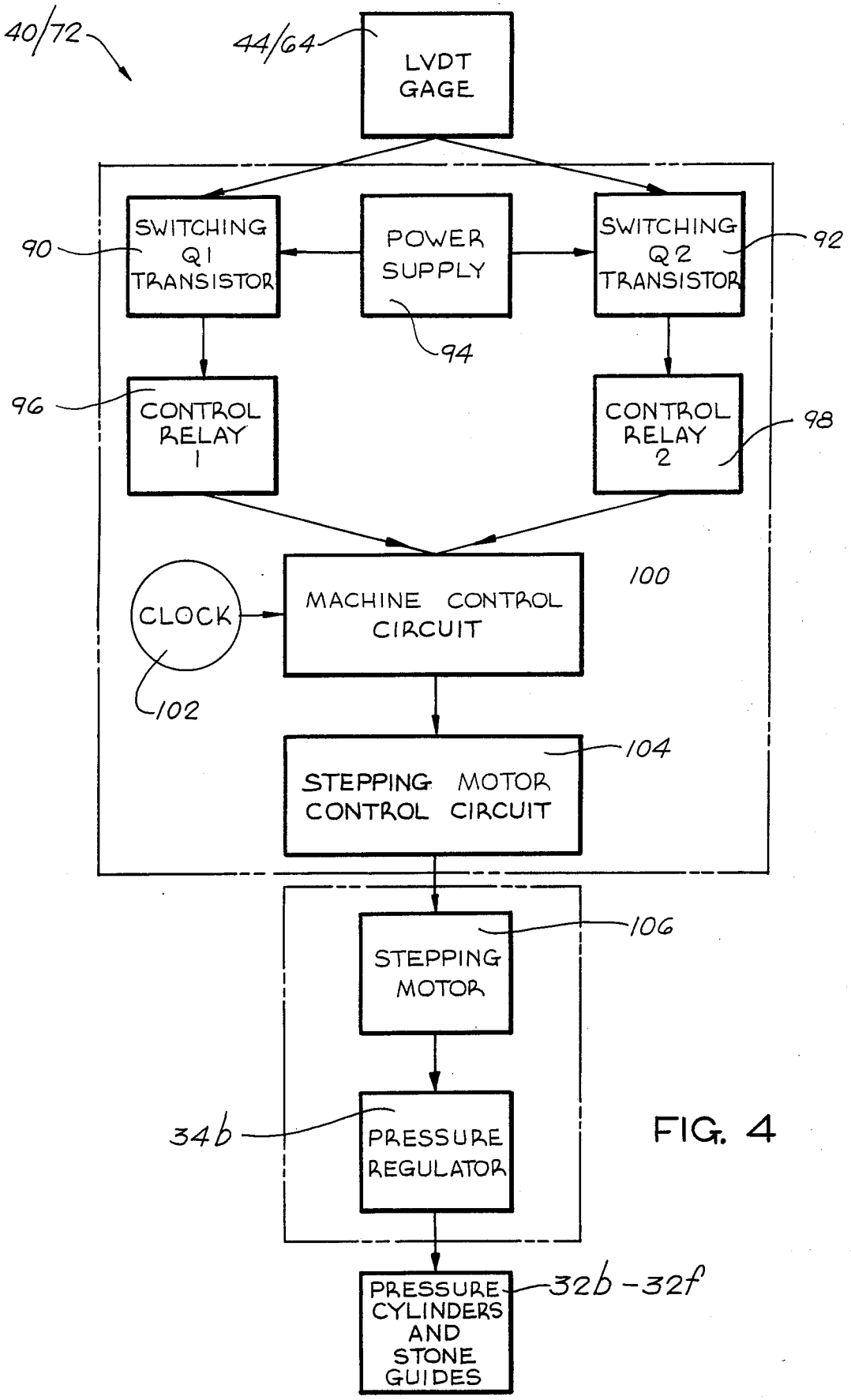
FIG. 4 is a block diagram of the control system for the centerless honing machines.

FIG. 4 is a block diagram of a portion of the automatic control system 40 for the honing machine 20 of FIG. 1. As previously indicated, the control system 40 may include the gaging device 44, which is shown in the form of a linear voltage displacement transformer (LVDT). However, the gaging device 44 may comprise a variety of other devices, adapted to produce gaging signals. For example, the gaging device may be of the type utilizing an air jet probe.

The gaging signals from the gaging device 44 are supplied to first and second switching transistors 90 and 92 which compare the gaging signals with the voltage from a power supply 94. The switching transistors 90 and 92 are adapted to operate first and second control relays 96 and 98.

These components of the control system 40 establish a narrow bandwidth of size variations for the workpieces 22. The relays 96 and 98 establish the upper and lower limits of the bandwidth. When the size of the workpieces exceeds the upper limit of the bandwidth, the first relay 96 pulls in or otherwise changes the setting of its contacts. When the size of the workpieces 22 becomes less than the lower limit of the bandwidth, the second relay 98 drops out or otherwise changes the setting of its contacts.

The output contacts of the relays 96 and 98 are connected to a machine control circuit 100 which may also receive timing signals from a clock or timer 102. At regular intervals, controlled by the clock 102, the machine control circuit 102 samples and stores the condition of the relay contacts for the first and second relays 96 and 98. At regular intervals, also controlled by the clock 102, the machine control unit 100 transmits operating signals to a stepping motor control circuit 104 which controls the operation of a stepping motor 106, connected to the fluid pressure regulator 34*b* and adapted to adjust the output pressure setting of the regulator. The stepping motor 106 and the stepping motor control circuit 104 may be of any known or suitable construction. Persons skilled in the art will be familiar with such stepping motors and control circuits.

At periodic intervals, as determined by the clock 102, the machine control circuit 100 samples the condition of the relays 96 and 98 and determines which of three possible conditions exists. The three possible conditions are an undersize condition, in which case both relays 96 and 98 are dropped out; an acceptable size condition within the bandwidth, in which case the first relay 96 is pulled in, while the second relay 98 is dropped out; or an oversize condition, in which case both relays 96 and 98 are pulled in. If the undersize condition exists, the control circuit 100 sends a reverse or "reduce pressure" signal to the stepping motor control circuit 104, whereupon the stepping motor 106 is stepped through one step in a reverse direction, to reduce the pressure setting of the regulator 34*b* by a small step.

If an acceptable size condition exists, within the bandwidth, the control circuit 100 does not send any signal to the stepping motor control module 104, so that no movement of the stepping motor 106 occurs. Thus, the pressure adjustment of the regulator 34*b* is not changed.

If an oversize condition exists, the control circuit 100 sends a forward or "increase pressure" signal to the stepping motor control circuit 104, whereupon the stepping motor is operated through one step in a forward direction so as to increase the pressure setting of the regulator 34*b* by a small step. The output fluid pressure from the pressure regulator 34*b* is supplied to the fluid pressure cylinders 32*b*–32*f*, which apply pressure to the honing stones 28*b*–28*f*, and also guide the stones for movement toward and away from the workpieces 22.

Thus, the automatic control system 40 increases the pressure between the workpieces 22 and the honing stones 28, to remove more stock from the workpieces if a slight oversize condition is detected by the gaging device 44. If the gaging device 44 detects a slight undersize condition, the pressure between the workpieces 22 and the honing stones 28 is reduced, to reduce the amount of stock removed by the honing stones from the workpieces. If the gaging device 44 determines that the size of the workpieces 22 is within the acceptable bandwidth, the existing pressure between the honing stones 28 and the workpieces 22 is maintained and is not changed.

Figure 5:
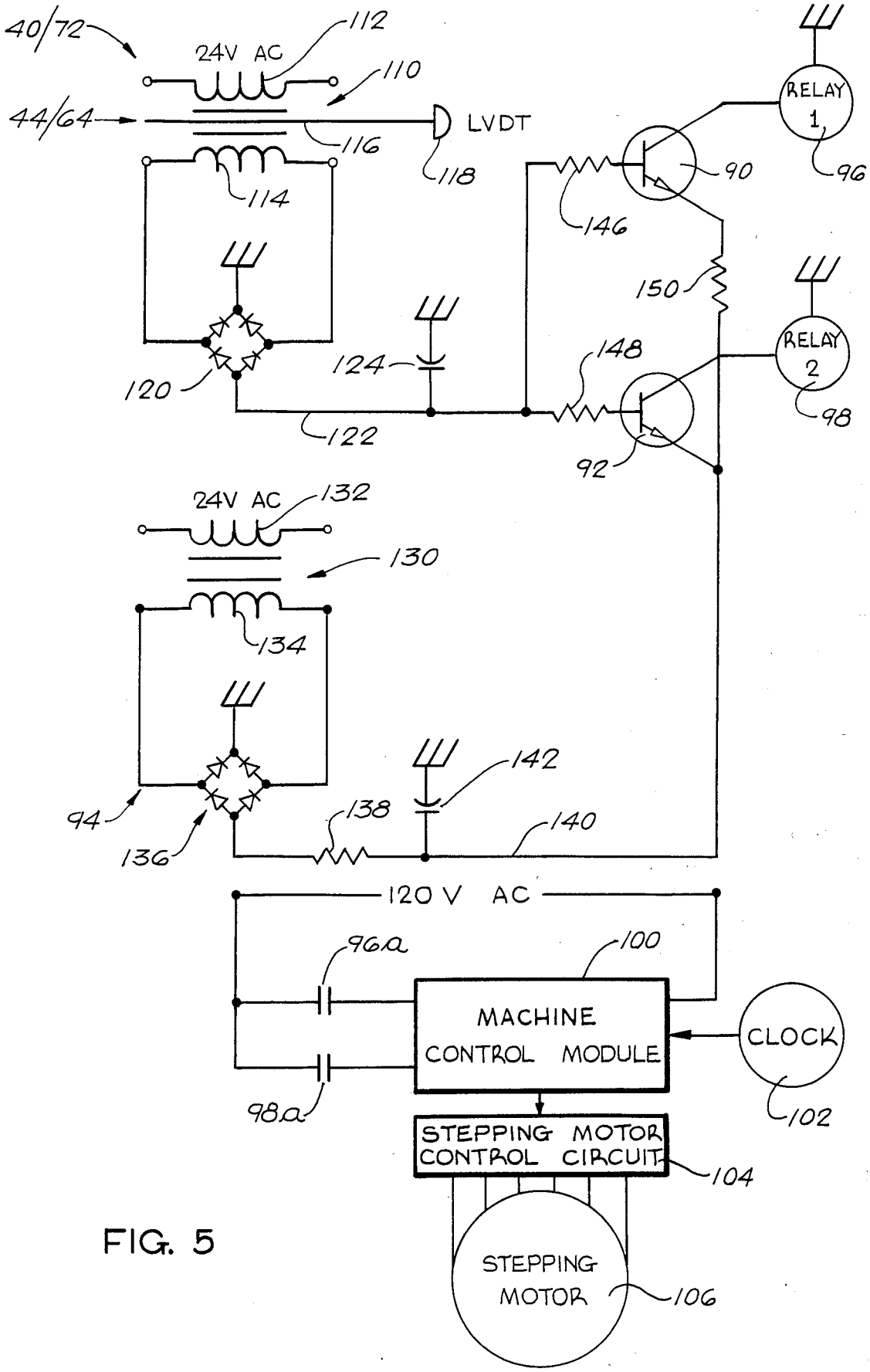
FIG. 5 is a schematic circuit diagram illustrating a portion of the control system.

FIG. 5 is a schematic circuit diagram illustrating additional details of the automatic control system 40 of FIGS. 1 and 4. Many of the components shown in FIGS. 4 and 5 are the same, and to that extent, the same reference characters have been employed in both figures. As previously indicated, the gaging device 44 may utilize a linear voltage displacement transformer (LVDT) 110 having primary and secondary winding 112 and 114, and a movable core member 116 which is adapted to vary the voltage developed in the secondary winding 114. The movable core member 116 carries a gaging probe or plunger 118 which engages the workpieces 22. Thus, any variation in the size of the workpieces changes the voltage developed in the secondary winding 114 of the transformer 110.

As indicated in FIG. 5, the primary winding 112 is supplied with alternating current (AC), such as 24 volts AC. The AC output of the secondary winding 114 is converted into direct current (DC) by a bridge rectifier 120. As shown, the positive output terminal of the rectifier 120 is connected to ground, while the negative output terminal is connected to a lead 122. A filtering or by-pass capacitor 124 is connected between the lead 122 and ground to remove most of the ripple from the DC output of the rectifier 120.

The power supply 94 is illustrated as comprising a transformer 130 having primary and secondary windings 132 and 134. The primary winding 132 is supplied with AC, such as 24 volts AC. The secondary winding 134 is connected to a bridge rectifier 136 which converts the DC output voltage to DC. The positive output terminal of the rectifier 134 is connected to ground while the negative terminal is connected through a filtering resistor 138 to a lead 140. A filtering or by-pass capacitor 142 is connected between the lead 140 and ground to remove most of the ripple from the DC output of the rectifier 136.

The lead 122 provides a DC gaging voltage which is supplied through a resistor 146 to the base of the first switching transistor 90. Similarly, the gaging voltage from the lead 122 is supplied to the base of the second switching transistor 92 through a resistor 148. The coil of the first control relay 96 is connected between ground and the collector of the first switching transistor 90. Similarly, the coil of the second control relay 98 is connected between ground and the collector of the second switching transistor 92. The emitter of the second transistor 92 is connected directly to the DC power supply lead 140. A current limiting resistor 150 is connected between the DC power lead 140 and the emitter of the first switching transistor 90.

The switching transistors 90 and 92 compare the gaging voltage from the lead 122 with the power supply voltage from the lead 140, because the gaging voltage is connected to the base of each transistor, while the power supply voltage is connected to the emitter of each transistor.

The control relay 98 is adjusted for slightly higher sensitivity than the control relay 96. The resistor 150 reduces the sensitivity of the relay 96. The relay 98 pulls in when the gaging voltage from the lead 122 exceeds the power supply voltage from the lead 140. This establishes the lower limit of the size bandwidth. The relay 96 pulls in at a slightly higher gaging voltage on the lead 122. This establishes the upper limit of the size bandwidth.

Referring to the lower portion of FIG. 5, the relays 96 and 98 have respective contacts 96*a* and 98*a* which are connected to the inputs of the machine control circuit 100. The inputs may be energized with AC, such as 120 volts AC, through the relay contacts 96*a* and 98*a*. The machine control circuit 100, the clock 102, the stepping motor control circuit 104 and the stepping motor 106 may be the same as described in connection with FIG. 4.

Figure 6:
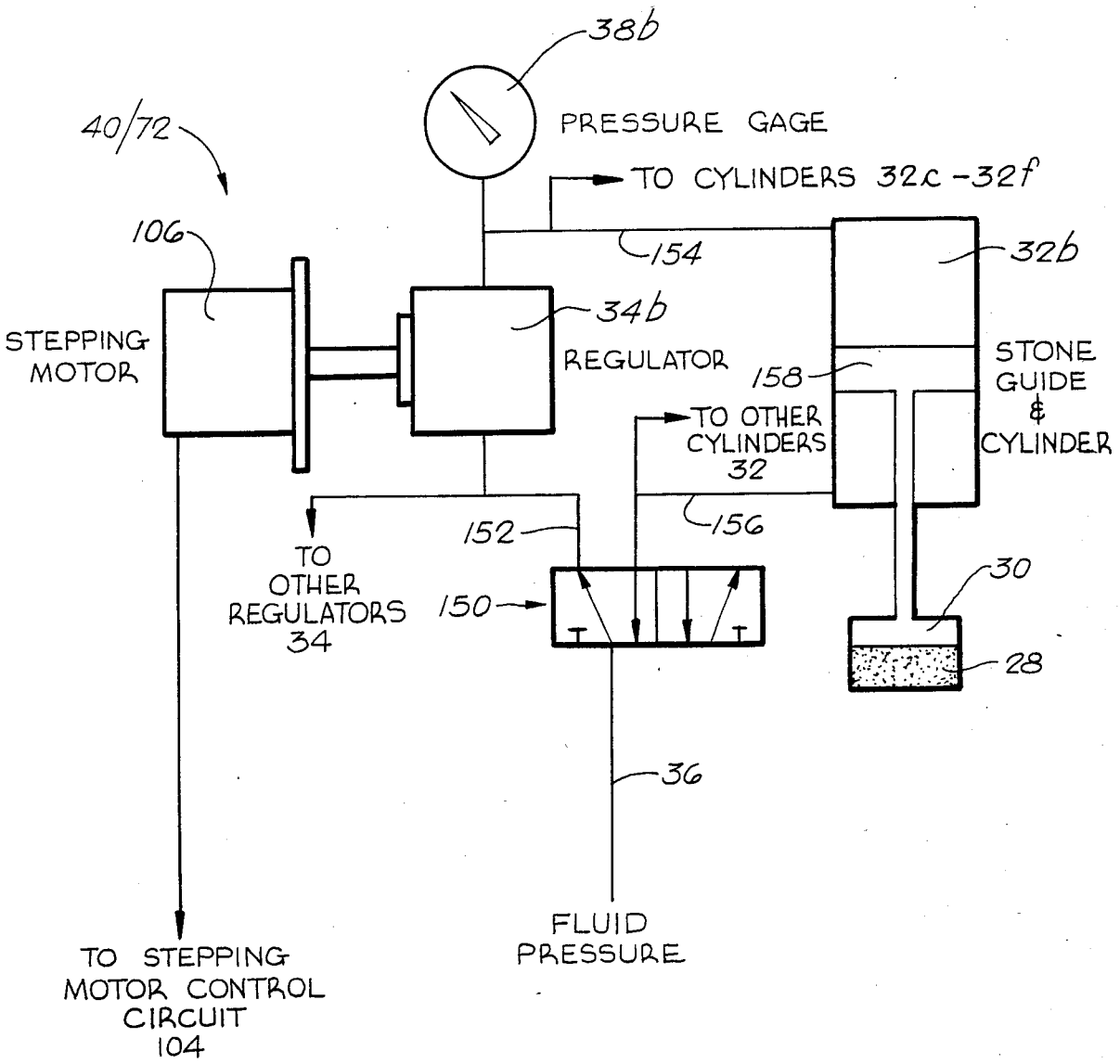
FIG. 6 is a diagrammatic view illustrating an additional portion of the control system.

FIG. 6 illustrates additional details of the control system 40. In FIG. 6, most of the components are the same as previously described and have been given the same reference characters. As shown in FIG. 6, the control system 40 includes a fluid control valve 150 which is connected between the fluid pressure supply line 36 and the supply line 152 extending to the pressure regulators 34. Only the pressure regulator 34*b* is shown in FIG. 6, but the supply line 152 may extend to all of the regulators 34, as indicated in FIG. 6. The purpose of the control valve 150 is to reverse the fluid pressure cylinders 32 so that the honing stones 28 are lifted away from the workpieces 22. In this way, it is easy to insert a stream of the workpieces 22 when the honing machine is being started.

As shown in FIG. 6, the fluid pressure cylinder 32*b* is double-acting. The upper end of the cylinder 32*b* is connected to the outlet line 154 from the pressure regulator 34*b*. As indicated in FIG. 6, the outlet line 154 is also connected to the cylinders 32*c*–32*f*. The lower end of the cylinder 32*b* is connected to a fluid carrying line 156, which is also connected to the lower ends of all of the other cylinders 32.

The control valve 150 is of the reversing type having two positions. In the position shown in FIG. 6, the valve 150 connects the fluid pressure supply line 36 to the line 152 which extends to the input connections of all of the regulators 34. The valve 150 connects the fluid line 156 to the atmosphere or to some other suitable exhaust connection, so that the air or other fluid is exhausted from the lower ends of the cylinders 32.

When the valve 150 is reversed to its second position, the fluid pressure supply line 36 is connected to the line 156, so that fluid pressure is supplied to the lower ends of the cylinders 32, while the line 52 is connected to the atmosphere or some other exhaust connection. Thus, the pistons 158 in the cylinders 32 are moved upwardly to lift the stones 28 away from the workpieces 22. It is then easy to load workpieces 22 into the honing machine 20. For normal honing operations, the valve 150 is returned to the position shown in FIG. 6, so that the cylinders 32 again apply pressure between the honing stones 28 and the workpieces 22.

FIGS. 4, 5 and 6 have been described in relation to the automatic control system 40 for the honing machine 20 which constitutes the embodiment of FIG. 1. However, FIGS. 4, 5 and 6 are also applicable to the automatic control system 72 for the honing machine 60, constituting the embodiment of FIG. 2. The control systems 40 and 72 may be essentially the same and may differ only as to matters of adjustment. Thus, the LVDT gage for the embodiment of FIG. 2 may be adjusted a slightly different control dimension, relative to the LVDT gage 44 for the embodiment of FIG. 1, because the gage 44 of FIG. 1 measures the size of the finished workpieces 22, after being honed, while the gage 64 of FIG. 2 measures the incoming workpieces 22 before they are honed. The timing provided by the clock 102 may also be adjusted accordingly for the two control systems 40 and 72 of FIGS. 1 and 2. In the case of the embodiment of FIG. 2, the sampling or updating frequency, provided by the clock 102, may be greater because the gaging is done before the workpieces 22 are honed, rather than after they are honed.

In the operation of the embodiment of FIG. 2, if the LVDT gage 64 detects slightly oversize workpieces, coming into the honing machine 60, the automatic control system 72 causes the stepping motor 106 to be driven stepwise in such a direction as to increase the pressure setting of the pressure regulator **34*b*, so that the combined pressure cylinders and stone guides 32*b*–38*f* will develop greater honing pressure between the honing stones 28*b*–28*f* and the workpieces 22**. In this way, a greater amount of stock will be removed by the honing stones, so as to correct the oversize condition.

On the other hand, if the gage 64 detects that the incoming workpieces 22 are slightly smaller than the nominal size, the control system 72 will cause the stepping motor 106 to rotate stepwise in the opposite direction, so as to decrease the pressure setting of the pressure regulator **34*b*. In this way, the pressure between the honing stones 28*b*–28*f* and the workpieces 22 will be decreased, so that slightly less stock will be removed by the honing stones. In this way, the undersize condition is corrected, so that the finished size of the workpiece 22** is held very closely to the desired dimension.

To indicate the applicability of FIGS. 4–6 to the embodiments of both FIGS. 1 and 2, the automatic control system of FIGS. 4–6 is identified in the drawings by both reference characters 40 and 72. Similarly, the LVDT gage is identified by both reference characters 44 and 64.

FIGS. **7*a* and 7*b* together constitute a schematic block diagram of a modified automatic control system 240, for the honing machine 20 and 60, constituting the embodiments of FIGS. 1 and 2. The automatic control system 240 may be employed to replace the control systems 40 and 72 of FIGS. 1, 2 and 4–6. The diagram of the control system 240 begins on FIG. 7*a* and continues on FIG. 7*b*. The control system 240** has the advantage of employing commercially available electronic control systems, modules and components. Such electronic control systems utilize microprocessors which are fully programmable, in a manner well known to those skilled in the art, so that the operating parameters of the honing machines can be selected and changed, as desired.

Figure 7A:
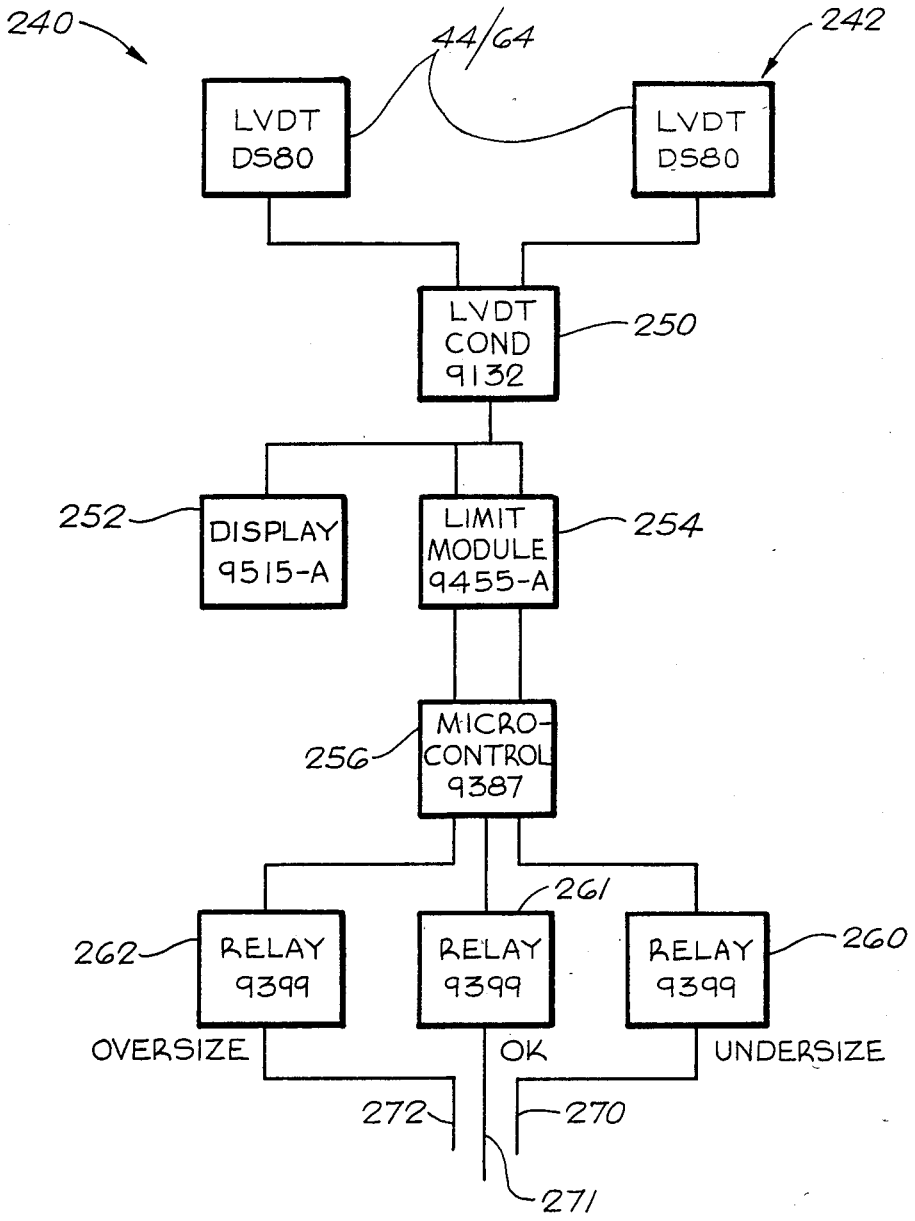
FIGS. 7*a*, 7*b* and 8 are schematic diagrams of modified control systems for the machines of FIGS. 1–3.
Figure 7B:
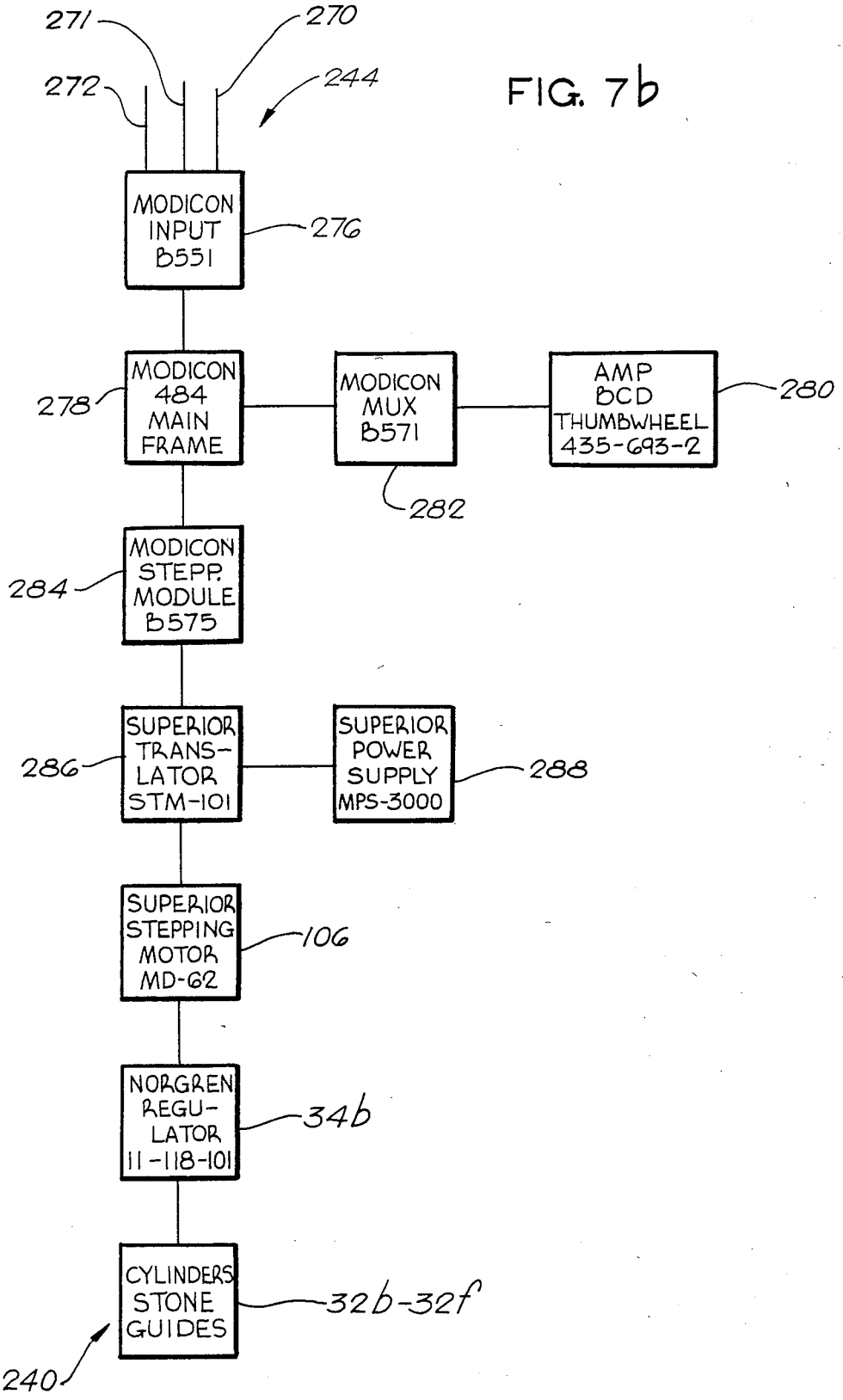

The control system 240 of FIGS. **7*a* and 7*b* comprises two subsystems 242 and 244, shown in FIGS. 7*a* and 7*b*, respectively. The subsystem 244 of FIG. 7*a* is commercially available as a Daytronics main frame, Model 9005. The subsystem 242 starts with the previously described LVDT gage 44 or 64, which may comprise Daytronics modules, Type DS 80. The outputs of such gauge modules 44 or 64 are supplied to a LVDT conditioner module 250, Type 9132, which converts the signals from the gage 44 or 64 into a variable analog output signal having a maximum value of about 5 volts. Such analog output signal is applied to a display module 252, Type 9515-A, which produces a digital readout of the analog output signal. It will be seen that the analog output signal is also supplied to a limit module 254, Type 9455A, which is adjustable by the operator to establish the dimensional limits, or upper and lower tolerance values, to be maintained by the honing machine. Thus, the limit module 254** establishes a dimensional bandwidth, within which the dimensions of the workpieces are to be maintained.

The outputs of the limit module 254 are supplied to a microcontrol module 256, Type 9387, which is a programable microprocessor, adapted to operate three control relays 260, 261 and 262, each being Type 9399. The relay 260 is operated if the gage 44 or 64 indicates that the workpieces are slightly undersize. The relay 261 is operated if the gage 44 or 64 indicates that the workpieces are o.k., in that they are within the desired dimensional or tolerance bandwidth. The relay 262 is operated if the gage 44 or 64 indicates that the workpieces are slightly oversize. The microcontrol module 256 follows the dimensional limits established by the limit module 254. Moreover, the microcontrol module 256 introduces any desired delay in the operation of the relays 260, 261 and 262, as selected by the operator. Furthermore, the microcontrol module 256 can be adjusted or programmed to utilize any desired sampling or updating rate.

The relays 260, 261 and 262 may be employed to produce any desired output voltage, either direct current or alternating current. In this case, the relays 260, 261 and 262 produce outputs at 120 volts alternating current at 60 hertz, to accommodate the input requirements of the subsystem 244, shown in FIG. **7*b*. The output signals from the relays 260, 261 and 262 are carried to the subsystem 244 by signal channels 270, 271 and 272, which are shown in both FIG. 7*a* and FIG. 7*b***.

The subsystem 244 of FIG. **7*a* employs the alternating current signals from the relays 260, 261 and 262 to operate the stepping motor 106, which in turn operates the variable pressure regulator 34*b*. As before, the regulator 34*b* controls the honing pressure exerted by the combination pressure cylinders and stone guides 32*b*–32*f*. As shown in FIG. 7*b*, the stepping motor 106 may be Superior Model MO-62. The variable pressure regulator 34*b*** may be Norgren Type 11-118-101.

As shown in FIG. **7*b*, the signal lines 270, 271 and 272 from the relays 260, 261 and 262 are connected to an input module 276 which may be Modicon Type B551, which affords access to a microprocessor main frame module 278, which may be Modicon Type 484. The operation of the stepping motor 106 can be adjusted by the operator by manipulating a selector module 280, which may be AMP BCD Thumbwheel module Type 435693-2, connected to the main frame module 278 by an MUX module 282, which may be Modicon Type B571. By manipulating the selector module 280**, the operator can supervise the finished dimensions of the workpieces.

The output of the microprocessor main frame module 278 controls a stepping motor control model 284, which may be Modicon Type B 575. The output of the module 284 is amplified by a translator module 286, which may be Superior Type STM-101, supplied with power by a power supply module 288, which may be Superior Type MPS-3000. The stepping motor 106 is connected to the output of the translator 286.

In the operation of the automatic control system 240 of FIGS. *7a* and *7b*, the LVDT gage 44 or 64 gages the workpieces and may indicate an undersize condition, an o.k. condition, or an oversize condition. An undersize condition causes operation of the relay 260, which in turn causes the stepping motor 106 to readjust the pressure regulator 34*b* to a slightly lower setting, so that the honing pressure is reduced slightly. In this way, slightly less stock is removed by the honing stones.

An oversize condition causes operation of the relay 262 which in turn causes operation of the stepping motor 106 in the opposite direction, so as to increase the honing pressure. In this way, the stock removed by the honing stones is slighly increased.

An o.k. condition causes operation of the relay 261, in which case the stepping motor 106 is not rotated, so that the existing pressure is maintained between the honing stones and the workpieces.

Figure 8:
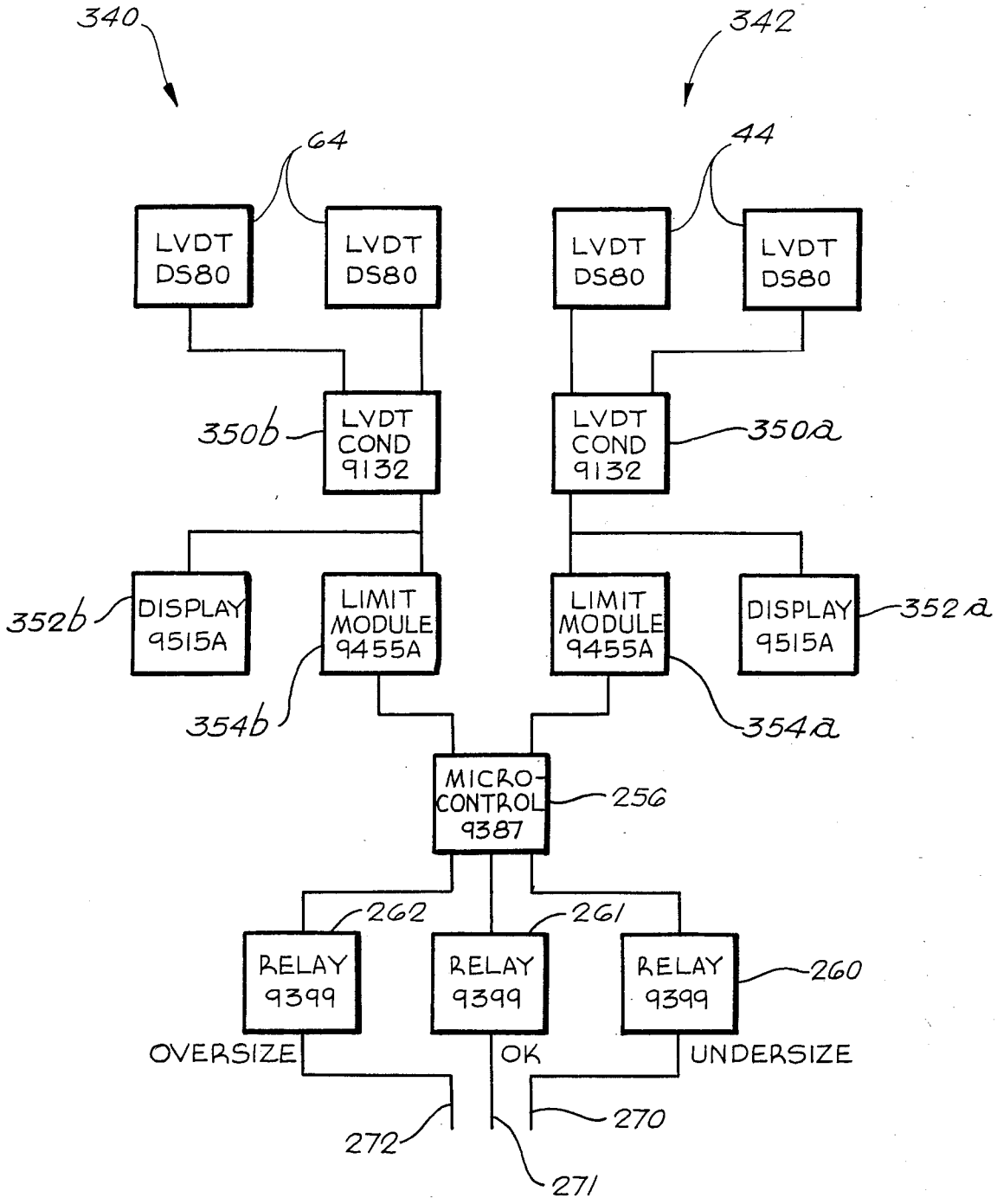

FIG. 8 illustrates an automatic control system 340 for the honing machine 80 of FIG. 3. The system 340 can be employed instead of the automatic control system 82 of FIG. 3. The control system 340 has the advantage of utilizing commercially available components, modules and control systems.

The automatic control system 340 comprises a subsystem 342, shown in FIG. 8, and the previously described subsystem 244, shown in FIG. *7b*. For use with the honing machine 80 of FIG. 3, the subsystem 342 of FIG. 8 replaces the subsystem 242 of FIG. *7a*. The control system 340 begins with the subsystem 342 of FIG. 8 and continues with the subsystem 244 of FIG. *7b*.

As previously described in connection with FIG. 3, the automatic control system 340 comprises both of the LVDT gages 44 and 64, for gaging the finished workpieces 22 and the incoming workpieces 22, respectively. The outputs of the gage 44 are connected to an LVDT conditioner module 350*a*, while the outputs of the gage 64 are connected to an LVDT conditioner module 350*b*. Each of the modules 350*a* and 350*b* may be the same as the module 250 of FIG. *7a* and thus may be Daytronics Type 9132. Similarly, the gages 44 and 64 may comprise Daytronics modules, Type D580.

As in the case of the module 250, the conditioner modules 350*a* convert the signals from the gages 44 and 64 into variable analog output signals having a maximum value of about 5 volts. The analog output signals from the modules 350*a* and 350*b* are supplied to respective display modules 352*a* and 352*b*, each of which may be Daytronics Type 9515A. The analog output signals from the modules 350*a* and 350*b* are also supplied to respective limit modules 354*a* and 354*b*, each of which may be Daytronics Type 9455A. As previously described, the limit modules 354*a* and 354*b* establish dimensional bandwidths or tolerance ranges for the respective gages 44 and 64, at the selection of the operator.

The outputs of the limit modules 354*a* and 354*b* are supplied to the previously described microcontrol module 256, which selectively operates one of the three relays 260, 261 and 262, as previously described.

By adjusting and programming the limit modules 354*a* and 354*b* and the microcontrol 256, the operator can establish the desired tolerance ranges for both gages 44 and 64. Moreover, the operator can establish any desired time delays in the operation of the relays 260, 261 and 262. Any desired sampling or updating rates can also be established.

Moreover, the operator can establish priority sequences, as between the two gages 44 and 64. For example, the gage 64 for the incoming workpieces 22 may initially be given priority to exercise a coarse and fast acting control over the stepping motor 106 and the pressure regulator 34*b*, so that the honing pressure will initially be varied according to whether the workpieces are slightly undersize, o.k. or slightly oversize. After some delay, the gage 44 may be given priority to produce a finer and slower acting adjustment of the stepping motor 106 and the pressure regulator 34*b*, to achieve even closer control over the tolerance range of the finished workpieces. If there is no significant change in the size of the incoming workpieces, the dimensional control may be exercised by the gage 44, which gages the finished workpieces. If there is a change in the size of the incoming workpieces, the incoming gage 64 may again be given priority to readjust the stepping motor 106 and the pressure regulator 34*b*. After a period of time for a coarse adjustment, the gage 44 may again be given priority by the microcontrol 256.

As before, the output channels 270, 271 and 272 from the relays 260, 261 and 262 of FIG. 8 may be connected to the inputs of the input module 276 of FIG. *7b*. The construction and operation of the subsystem 244 of FIG. *7b* may be the same as previously described.

What is claimed is:

1. A centerless honing machine for honing predetermined external generally cylindrical surfaces on a series or workpieces, said honing machine comprising a pair of spaced adjacent rotary roller means for supporting and rotating the workpieces while also causing the workpieces to travel axially along said roller means, at least one honing element for engaging and honing said predetermined external generally cylindrical surfaces of the successive workpieces as they travel axially along said roller means, pressing means operable by fluid pressure for pressing said honing element against said surfaces of the workpieces, gaging means for gaging the size of the predetermined external generally cylindrical surfaces on the workpieces and for producing signals indicating the relationship between the size of said surfaces of the workpieces and the desired size, adjustable pressure regulating means for supplying adjustable fluid pressure to said pressing means, and control means operable in response to said signals for ajusting said adjustable pressure regulating means to increase or decrease the fluid pressure and thereby to increase or decrease the amount of stock removed from said surfaces of the workpieces by said honing element to achieve closer agreement between the finished size of said surfaces of the workpieces and the desired size.

2. A honing machine according to claim 1, said gaging means being located to gage the size of said surfaces of said workpieces as they travel toward said honing element and before they are engaged by said honing element.

3. A honing machine according to claim 1, said gaging means being located to gage the finished size of said surfaces of the workpieces as they travel away from said honing element after being engaged and honed by said honing element.

4. A honing machine according to claim 1, including a plurality of such honing elements for successively engaging and honing said surfaces of the traveling workpieces, said honing elements being operable by said pressing means.

5. A honing machine according to claim 1, including a plurality of such honing elements for successively engaging and honing said surfaces of the travelling workpieces, and a plurality of such pressing means for pressing the respective honing elements, said control means including a motor for adjusting said pressure regulating means for varying the fluid pressure supplied to the respective pressing means.

6. A honing machine according to claim 1, in which said honing element is in the form of an abrasive element for honing said surfaces of the workpieces.

7. A honing machine according to claim 1, in which said honing element is in the form of a honing stone or honing said surfaces of the workpieces by abrasion.

8. A centerless honing maching for honing predetermined external generally cylindrical surfaces on a series of workpieces, said honing machine comprising a pair of spaced adjacent rotary roller means for supporting and rotating the workpieces while also causing the workpieces to travel axially along said roller means, at least one honing element for engaging and honing said predetermined external generally cylindrical surfaces of the successive workpieces as they travel axially along said roller means, pressing means operable by fluid pressure for pressing said honing element against said surfaces of the workpieces, gaging means for gaging the size of the predeterined external generally cylindrical surfaces on the workpieces and for producing signals indicating the relationship between the size of said surfaces of the workpieces and the desired size, adjustable pressure regulating means for supplying adjustable fluid pressure to said pressing means, and control means operable in response to said signals for adjusting said adjustable pressure regulating means to increase or decrease the fluid pressure and thereby to increase or decrease the amount of stock removed from said surfaces of the workpieces by said honing element to achieve closer agreement between the finished size of said surfaces of the workpieces and the desired size, said gaging means including first and second gaging devices for gaging the size of said surfaces of the workpieces before and after said surfaces are engaged and honed by said honing element, both of said gaging devices producing gaging signals which are supplied to said control means, said first gaging device being located to gage the size of said surfaces of the workpieces as they travel toward said honing element and before said surfaces are engaged by said honing element, said second gaging device being disposed to gage the finished size of said surfaces of the workpieces as they travel away from said honing element after surfaces have been honed by said honing element, said control means being responsive to the gaging signals from both said first and second gaging devices.

9. A honing machine according to claim 8, including a plurality of such honing elements for successively engaging and honing said surfaces of the traveling workpieces, and a plurality of such pressing means for pressing the honing elements successively against said surfaces.

10. A centerless honing machine for honing external generally circular surfaces on a series of workpieces, said honing machine comprising a pair of spaced adjacent rotary roller means for supporting and rotating the workpieces while also causing the workpieces to travel axially along said roller means, at least one honing stone for engaging and honing said surfaces on the successive workpieces as they travel axially along said roller means, pressing means operable by fluid pressure for pressing said honing stone against said surfaces of the workpieces, gaging means for gaging the size of said external generally circular surfaces on the workpieces and for producing signals indicating the relationship between the size of said surfaces of the workpieces and the desired size, adjustable pressure regulating means for supplying adjustable fluid pressure to said pressing means, power operable adjusting means for adjusting said adjustable pressure regulating means in opposite directions, and control means operable in response to said signals for actuating said adjusting means and thereby adjusting said pressure regulating means to increase or decrease the fluid pressure and thereby to increase or decrease the amount of stock removed from said surfaces of the workpieces by said honing stone to achieve closer agreement between the finished size of said surfaces and the desired size.

11. A honing machine according to claim 10, said adjusting means comprising a reversible motor operable by said control means and connected to said adjustable pressure regulating means for increasing or decreasing the fluid pressure.

12. A honing machine according to claim 10, said adjusting means comprising a reversible stepping motor operable by said control means and connected to said adjustable pressure regulating means for increasing or decreasing the fluid pressure.

* * * * *